US005293651A

United States Patent [19]

Johansson

[11] Patent Number: 5,293,651

[45] Date of Patent: Mar. 15, 1994

[54] TOILET SEAT

[76] Inventor: Lasse Johansson, 17740 Kasiniemi, Finland

[21] Appl. No.: 916,984

[22] PCT Filed: Dec. 20, 1990

[86] PCT No.: PCT/FI90/00307

§ 371 Date: Aug. 13, 1992

§ 102(e) Date: Aug. 13, 1992

[87] PCT Pub. No.: WO91/09562

PCT Pub. Date: Jul. 11, 1991

[30] Foreign Application Priority Data

Dec. 29, 1989 [FI] Finland ..... 896362

[51] Int. Cl.[5] ..... E03D 1/012; E03D 5/014

[52] U.S. Cl. ..... 4/420; 4/434; 4/436; 4/471; 4/473

[58] Field of Search ..... 4/420, 434, 436, 250, 4/466, 467, 468, 473, 471, 483, 435, 437, 438, 441

[56] References Cited

U.S. PATENT DOCUMENTS

| | | | |
|---|---|---|---|
| 113,369 | 4/1871 | Vanderveer | 4/466 |
| 398,516 | 2/1889 | Lattan et al. | 4/466 |
| 499,033 | 6/1893 | Passover | 4/468 |
| 1,019,593 | 3/1912 | Brown | 4/434 |
| 1,645,799 | 10/1927 | Carpenter et al. | 4/471 |
| 1,683,924 | 9/1928 | Schwarz et al. | 4/434 |
| 2,604,635 | 7/1952 | Goins et al. | 4/471 |
| 4,001,108 | 1/1977 | Hellqvist . | |
| 4,092,744 | 6/1978 | Butoi | 4/447 |

FOREIGN PATENT DOCUMENTS

| | | | |
|---|---|---|---|
| 59253 | 1/1913 | Austria | 4/420 |
| 254080 | 5/1967 | Austria | 4/434 |
| 1054307 | 5/1979 | Canada . | |
| 2425333 | 1/1975 | Fed. Rep. of Germany . | |
| 1093803 | 5/1955 | France . | |
| 617842 | 6/1980 | Switzerland . | |
| 3571 | of 1876 | United Kingdom . | |

*Primary Examiner*—Henry J. Recla
*Assistant Examiner*—Charles R. Eloshway
*Attorney, Agent, or Firm*—Lorusso & Loud

[57] ABSTRACT

A toilet seat for composting toilets, which toilet seat comprises a seat ring, a bowl space, a bottom hole of the bowl space, and a separator of liquids such as washing water and urine. The toilet seat is implemented by adapting the inside surface of the front part of the bowl space to be at its upper part essentially vertical, at its middle part almost horizontal, and at its lower part convexly curved so that the center part of the curved area is closer to the rear part of the bowl space than the start and end points of the convexly shaped lower part, whereby liquids entering the front part of the bowl space in the toilet seat are conducted along the inside surface of the front part into a separate liquids collection container, or alternatively, to a treatment process, and that the liquids separator is formed by a shutter adapted to the lower part of the bowl space or below it.

8 Claims, 2 Drawing Sheets

TOILET SEAT

Figure 1:
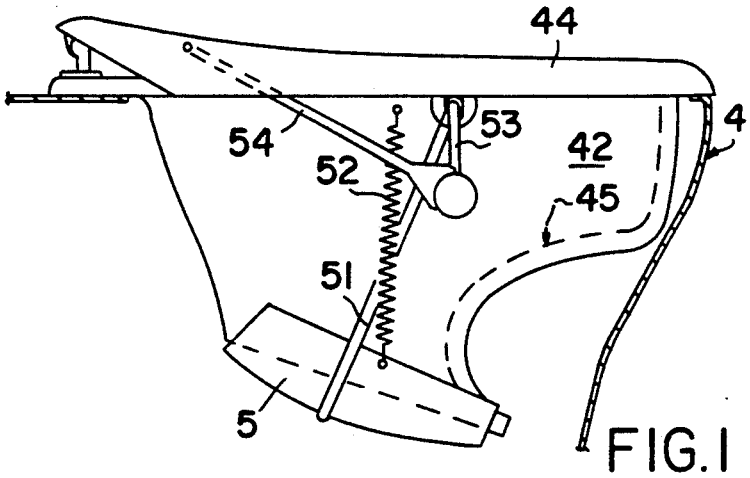

The present invention concerns a toilet seat for composting toilets, said toilet seat comprising a seat ring, a bowl space, a bottom hole of the bowl space, and separation means for liquids such as washing water and urine.

Composting toilets of prior art have been equipped with toilet seats containing no facilities for the separation of liquids, whereby urine and other liquids entering the toilet seat have landed into the same space with the bulk to be composted. The composting process is deteriorated thereof due to the excessive moisture content of the bulk and the disturbed balance of the carbon/nitrogen ratio by the surplus nitrogen from the urine.

Known in the art are also composting toilet constructions in which the liquids separation means of the toilet seats have been designed to be comprised of relatively simple baffles and similar elements. In these toilet seats a portion of the urine frequently ends up into the bulk to be composted, thus disturbing the composting process. The use of these toilet seats is further hampered by other drawbacks. For instance, urination is possible only in a sitting position. Moreover, the cleaning of the interior surfaces of the toilet seat with water is cumbersome, since the water entering the seat can reach the composting space, therein disturbing the composting process.

It is an object of the present invention to achieve a novel type of toilet seat for composting toilets, said toilet seat being capable of overcoming the drawbacks described above. The toilet seat in accordance with the invention is characterized by having the inside surface of the front part of the bowl space adapted to be at its upper part essentially vertical, at its middle part almost horizontal, and at its lower part convexly curved so that the center part of the curved area is closer to the rear part of the bowl space than the start and end points of the convexly shaped lower part, whereby liquids entering the front part of the bowl space in the toilet seat are conducted along the inside surface of the front part into a separate liquids collecting container, or alternatively, to a treatment process, and by having the liquids separation means formed by a shutter adapted to the lower part of the bowl space or below it.

A preferred embodiment of the toilet seat in accordance with the invention is characterized in that the shutter is transferrable so as to make it possible to close entirely or partially the connection via the bottom hole of the bowl space to the composting space.

Another preferred embodiment of the apparatus in accordance with the invention is characterized in that the shutter is transferrable in the longitudinal direction of the toilet seat between its lowered position under the bowl space and its rear position by means of a transfer mechanism which is connected to the shutter.

A further another preferred embodiment of the apparatus in accordance with the invention is characterized in that the transfer mechanism of the shutter is comprised of lever arms having their one end pivotally connected to the edges of the bowl space and the other end to the shutter; of springs having their one end attached to the shutter and the other end to the edge of the bowl space; and of an operating lever adapted to that end of the lever arms which is at the bowl space side.

The toilet seat in accordance with the invention manages the liquids separation without the need for auxiliary means, whereby the design of the inside surface of the seat bowl acts as the liquids separator. Due to the washing possibility, the toilet seat can be kept hygienic and pleasant to use. Furthermore, the construction achieves the possibilities of urination in the conventional manners, either standing or sitting. Combination of a hand-held shower head with the toilet seat in accordance with the invention extends its use as a bidet.

Figure 2:
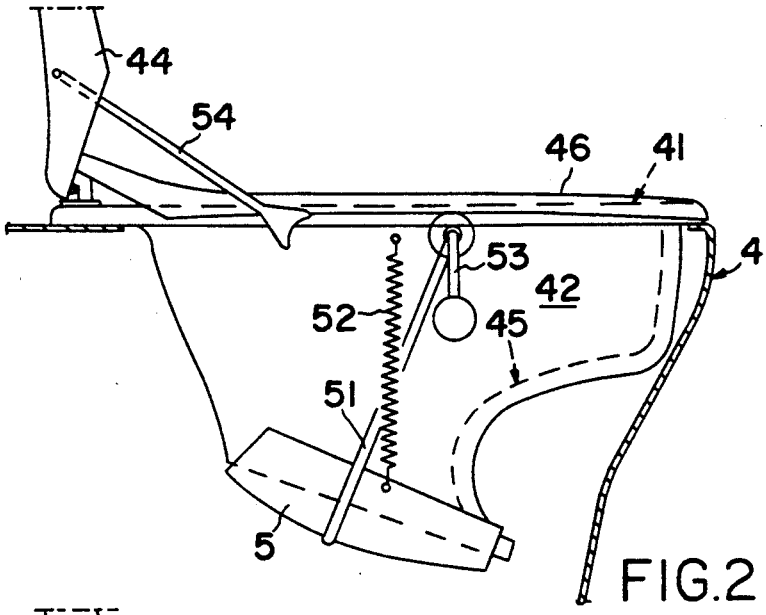
Figure 3:
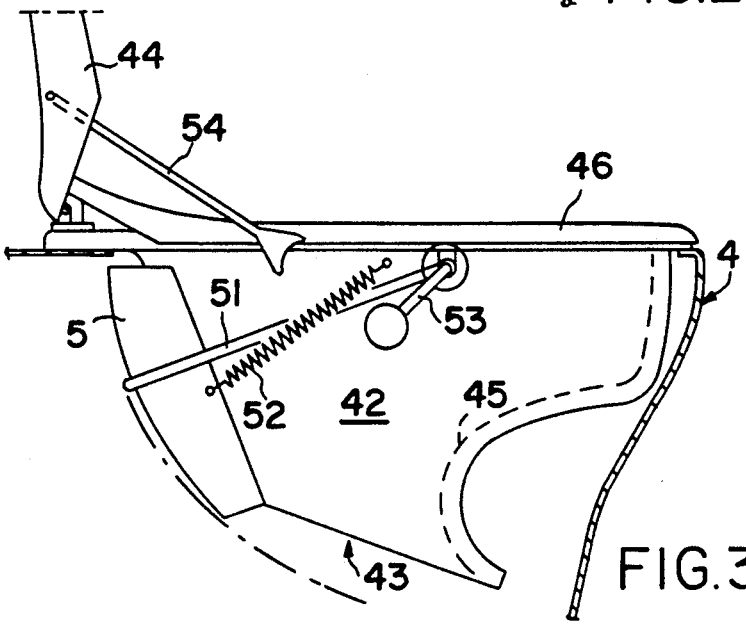
Figure 4:
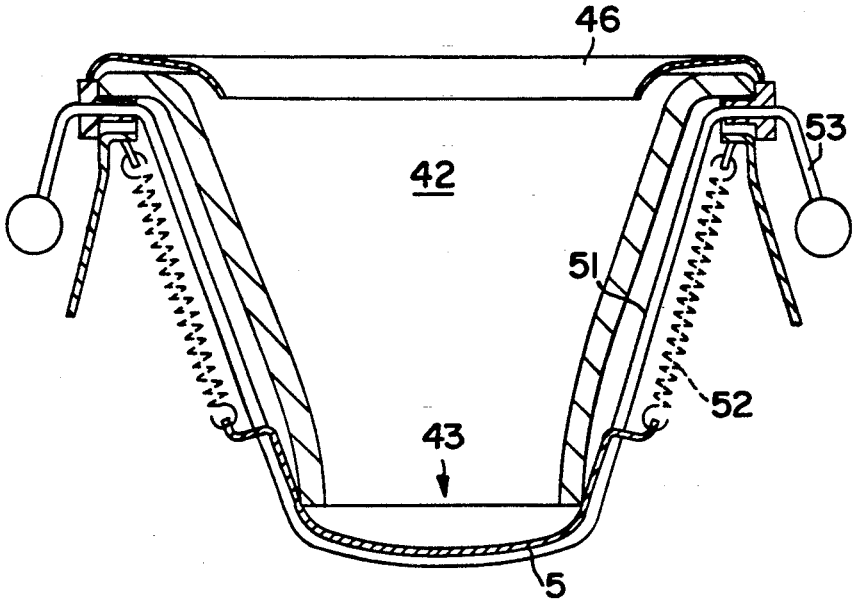
Figure 5:
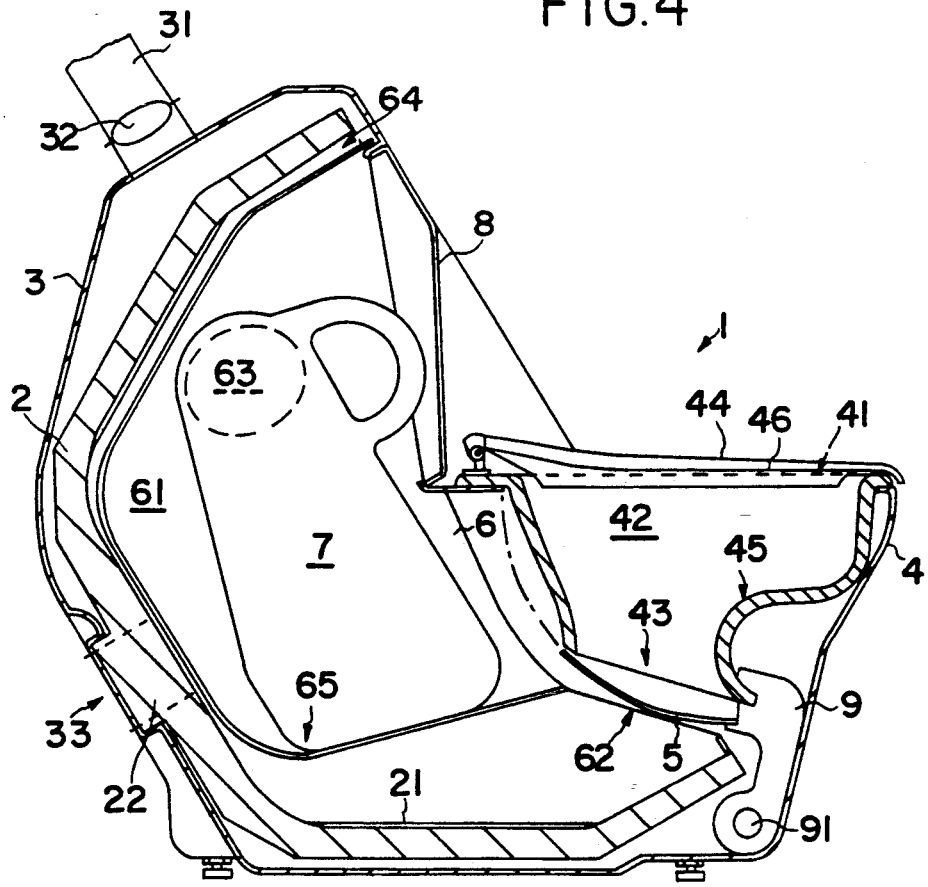

In the following, the invention will be examined in more detail with the help of a preferred exemplifying embodiment with reference to the attached drawings, in which FIGS. 1–3 show diagrammatically in a side view a toilet seat in accordance with the invention, FIG. 4 shows in a partially sectional front view a toilet seat in accordance with the invention, and FIG. 5 shows a toilet seat in accordance with the invention adapted to a composting equipment.

FIGS. 1–3 illustrate a toilet seat 4 in accordance with the invention, together with the attached liquids separation means 5. The toilet seat 4 has the inside surface 45 of the front part of the bowl space 42 adapted to be essentially vertical at its upper part, and at its middle part almost horizontal so that liquids entering the upper part of the bowl space 42 flow at a low speed along the inside surface 45. After the middle part, the inside surface 45 is shaped convexly curved so that the center part of the curved area is closer to the rear part of the bowl space 42 than the start and end points of the convexly shaped lower part, whereby liquids are conducted along the inside surface 45 of the front part into a separate collection container, or alternatively, to a treatment process. The convexly shaped lower part is designed for maximum radius, thereby reducing the centripetal force component that tends to detach the liquid flow from the inner surface 45. The convexly shaped lower part of the inside surface 45 of the front part in the bowl space 42 bends over a liquid collecting channel leading to a liquids collecting container or equivalent so that the convexly shaped part prevents solid waste from entering the liquid-collecting channel, and vice versa, the liquids from entering the composting space. Such a design of the inside surface 45 of the bowl space 42 achieves liquids separation without the need for specific means of liquids separation.

Adapted below the bowl space 42 of the toilet seat 4 is a shutter 5, which closes communication via the bottom hole 43 to the composting space. The shutter 5 is shown in FIGS. 1 and 2 in a position closing communication to the composting space. Thus, the situation illustrated in FIG. 2 makes it possible to bring liquids into the bowl space 42 in order to, e.g., wash the inside of the bowl space, yet avoiding the entry of the liquids into the composting space below the bottom hole 43, but instead, directing them into the liquid-collecting channel. The shutter 5 is easily transferrable aside from below the bottom hole 43, whereby the discharge of solid waste into the composting space becomes possible. Such a construction is illustrated in FIG. 3, in which a pressing force exerted on the seat ring 46 results in the transfer of the shutter 5 to its rear position by the effect of a spring 52 and lever arms 51. The transfer mechanism of the shutter 5 is comprised of lever arms 51, whose one end is pivotally connected to the edges of the bowl space 42 and the other end to the shutter 5, of the springs 52 having their one end attached to the shutter 5 and the other end to the edge of the bowl space, and of an operating lever adapted to that end of the lever arms 51 which is at the bowl space side. The connection of the lever arms 51 to the edges of th ®bowl space is adapted be resilient, principally in the direction of the longitudinal axis of the lever arms 51. The shutter 5 stays in this situation in its lower position by virtue of resting against the lower edge of the bowl space. When the lever arms 51 are pushed downward, the shutter 5 is opened by means of the spring 52. The shutter 5 reverts to its lower position shown in FIG. 1 by, e.g., pulling from an operating lever adapted to effect on the lever arm 51, or alternatively, by operating a return member 54 such as a push rod which is attached to the seat ring cover 44 and adapted to move the operating lever 53.

The opening motion of the shutter 5 can be achieved by the effect of, e.g., the seat ring 46 or a similar member, which exerts a pressing force on the pivotal joint of the lever arms 51 when the seating person exerts a pressing force on the seat ring 46.

FIG. 4 shows the toilet seat in accordance with the invention in partially sectioned front view. In this diagram the shutter 5 is trough-shaped and moved to its lower position.

FIG. 5 shows an entity comprising the toilet seat 4 in accordance with the invention combined with a composting equipment. These two components together form a composting toilet. The composting toilet illustrated in FIG. 5 is disclosed in a parallel patent application.

The toilet seat 4 can be connected to a water pipe, thereby making it possible to flush the inside of the bowl space 42. This flushing facility can be combined with an automatically operating mechanism which closes the shutter 5 at the opening of a valve in the water pipe.

Furthermore, the toilet seat in accordance with the invention is suitable for use as a bidet when completed with a hand-held shower head.

For those versed in the art, it is obvious that the invention is not limited to the exemplifying embodiments described above; by contrast, the invention can be varied within the claims disclosed herein.

What is claimed is:

1. A toilet seat for composting toilets, said toilet seat comprising:

a) a bowl having a seat rim;

b) a seat cover attached to the bowl;

c) a seat ring attached to the bowl;

d) an interior bowl surface having a front part, a rear part, two side parts, and a bottom hole;

the front part of said interior bowl surface having an upper section, a middle section, and a curved lower section, with the upper section adapted to be essentially vertical, the middle section almost horizontal, and the curved lower section having a top end, a middle segment, and a bottom end, said curved lower section being convexly curved so that the apex of the curve is within the middle segment of said curved lower section closer to the rear part of the interior bowl surface than are either the top or bottom ends of said curved lower section; and e) means for separating liquids, such as urine, from solid waste, such means comprising a shutter adapted to fit tightly against said bottom hole along the rear part and side parts of said interior bowl surface, but not the bottom end of the curved lower section of the front part of said interior bowl surface;

whereby liquid deposited on the front part of the interior bowl surface are conducted along the front part of said interior bowl surface into said liquids separation means.

2. A toilet seat as claimed in claim 1, characterized in that the shutter is transferrable between a lowered position under the bowl space and a raised position and is capable of closing incrementally communication via the bottom hole of the bowl space.

3. A toilet seat as claimed in claim 1, characterized in that the shutter is transferrable between a lowered position under the bowl space and a rear position by means of a transfer mechanism connected to the shutter.

4. A toilet seat as claimed in claim 3, characterized in that the transfer mechanism of the shutter comprises lever arms having a longitudinal axis and a radial axis and each having one end pivotally connected to an edge of the bowl space thereby forming a pivotal joint element and the other end to the shutter; springs each having one end attached to the shutter and the other end to an edge of the bowl space; and operating levers connected to the ends of the lever arms which are at the bowl space side.

5. A toilet seat as claimed in claim 4, characterized in that the connections of the lever arms to the edges of the bowl space are adapted to be resilient particularly in the direction of the longitudinal axis of the lever arms.

6. A toilet seat as claimed in claim 5, characterized in that the seat ring is positioned above the seat rim of the toilet seat, said seat ring being arranged to move the joint element of the lever arms so as to make the lever arms move in the direction of their longitudinal axis when a pressing force is exerted on the seat ring.

7. A toilet seat as claimed in claim 4 characterized in that a return member is connected to the cover of the toilet seat for the return movement of the shutter.

8. A toilet seat as claimed in claim 7, characterized in that the return member is a pivotally mounted push rod adapted to move the operating lever.

* * * * *